US006412725B2

(12) United States Patent
Inana et al.

(10) Patent No.: US 6,412,725 B2
(45) Date of Patent: Jul. 2, 2002

(54) SUPPLY MAGAZINE FOR CONTAINING RECORDING MATERIAL ROLL

(75) Inventors: Katsuya Inana; Tomohiko Kono, both of Saitama (JP)

(73) Assignee: Fuji Photo Film. Co., Ltd., Kanagawa (JP)

( * ) Notice: Subject to any disclaimer, the term of this patent is extended or adjusted under 35 U.S.C. 154(b) by 1 days.

(21) Appl. No.: 09/757,493

(22) Filed: Jan. 11, 2001

(30) Foreign Application Priority Data

Jan. 11, 2000 (JP) ..... 2000-002086

(51) Int. Cl.[7] ..... G03B 23/02

(52) U.S. Cl. ..... 242/348; 242/349; 242/358.1; 242/564.5; 396/512

(58) Field of Search ..... 242/348, 349, 242/358.1, 393, 564.5, 588.6; 396/512

(56) References Cited

FOREIGN PATENT DOCUMENTS

JP 10-291350 11/1998

*Primary Examiner*—John Q. Nguyen

(57) ABSTRACT

A supply magazine contains a recording paper roll constituted by continuous thermosensitive recording paper wound in a roll form. The recording paper is fed-by a supply roller. In the supply magazine, a magazine body receives the recording paper roll. A magazine lid closes the magazine body openably. Two retention levers are shiftable between retaining and releasing positions, press an outermost turn of the recording paper roll to the supply roller when in the retaining position, and release the recording paper roll from the supply roller when in the releasing position. A combination of two linking plates has first and second ends. The first end is connected with the magazine lid. The second end is connected with each of the retention levers. The linking plates shift each retention lever from the releasing position to the retaining position in response to closing of the magazine lid.

13 Claims, 12 Drawing Sheets

SUPPLY MAGAZINE FOR CONTAINING RECORDING MATERIAL ROLL

BACKGROUND OF THE INVENTION

1. Field of the Invention

The present invention relates to a supply magazine for containing a recording material roll. More particularly, the present invention relates to a supply magazine for containing a recording material roll, in which the recording material roll can be stably in contact with a supply roller.

2. Description Related to the Prior Art

JP-A 10-291350 discloses a supply magazine used with a printer for containing a recording material roll. The supply magazine includes a magazine body and a magazine lid. The magazine body is loaded with the recording material roll. The magazine lid closes the magazine body openably. A rotatable supply roller is disposed in the magazine body. A drive mechanism in the printer rotates the supply roller, and advances the recording material roll from the supply magazine to the inside of the printer. The advance of the recording material roll should be reliable. To this end, a pushing mechanism is disposed in the supply magazine for pushing an outermost turn of the recording material roll to the supply roller in a constant manner.

The pushing mechanism includes a retention lever and a spring. The retention lever is movable between retaining and releasing positions. The retention lever, when in the retaining position, presses the recording material roll against the supply roller, and when in the releasing position, discontinues applying pressure to the recording material roll. The spring is secured between the retention lever and the magazine lid. When the magazine lid is opened, the spring pulls the retention lever to the releasing position. When the magazine lid is closed, the retention lever is pushed by the spring to the retaining position.

However, the magazine lid swings in a large range of a rotational angle. The spring must extend and compress according to the swinging range, and is likely to be deformed or crept. The pushing mechanism according to the prior art has shortcomings in low reliability.

SUMMARY OF THE INVENTION

In view of the foregoing problems, an object of the present invention is to provide a supply magazine for containing a recording material roll, in which a pushing mechanism can keep the recording material roll stably contacted on a supply roller.

In order to achieve the above and other objects and advantages of this invention, a supply magazine contains a recording material roll constituted by continuous recording material wound in a roll form, the recording material being fed by a supply roller. In the supply magazine, a magazine body receives the recording material roll. A magazine lid closes the magazine body openably. At least one retention lever is shiftable between retaining and releasing positions, for pressing an outermost turn of the recording material roll to the supply roller when in the retaining position, and for releasing the recording material roll from the supply roller when in the releasing position. A linking mechanism has first and second ends, the first end being connected with the magazine lid, the second end being connected with the retention lever, the linking mechanism shifting the retention lever from the releasing position to the retaining position in response to closing of the magazine lid.

Furthermore, a magazine opening is formed in the magazine body and closed by the magazine lid. A hinge mechanism is secured to an edge of the magazine opening, for keeping the magazine lid pivotally movable on the magazine body between closed and open positions.

In a preferred embodiment, the supply magazine comprises the supply roller contained in the magazine body.

Furthermore, an exit passageway is formed in the magazine body and close to the supply roller, for exiting the recording material.

Furthermore, a roll holder is secured to a rotational axis of the recording material roll, has first and second axial end parts, supports the recording material roll. The at least one retention lever comprises first and second retention levers for pushing respectively the first and second axial end parts directly or indirectly.

The magazine lid and the magazine opening are disposed at a top of the magazine body, and the exit passageway is formed in a lower wall of the magazine body. Furthermore, a lower lid closes the exit passageway openably.

Furthermore, first and second support plates are disposed in the magazine body, and opposed to each other. First and second cutouts are formed through the first and second support plates, for receiving insertion of the first and second axial end parts. The first and second retention levers push portions of respectively the first and second axial end parts located outside the first and second support plates.

The linking mechanism includes at least first and second linking plates, the first linking plate having the first end and a third end, the second linking plate having the second end and a fourth end connected with the third end in a pivotally movable manner, the first and second linking plates transmitting rotation of the magazine lid to the retention lever when a rotational position of the magazine lid is within a limited section between the closed and open positions.

Furthermore, a bias mechanism biases the retention lever toward the releasing position when the retention lever is between one intermediate position and the releasing position, and biases the retention lever toward the retaining position when the retention lever is between the intermediate position and the retaining position.

Furthermore, a pivotal pin supports the retention lever on the magazine body in a pivotally movable manner. The bias mechanism includes a tension coil spring. A first securing portion secures one end of the tension coil spring to the magazine body. A second securing portion is disposed in the retention lever and on an extension of a line where the first securing portion and the pivotal pin lies, for securing a remaining end of the tension coil spring to the retention lever.

The magazine lid, while swung toward the closed position, pushes the third or fourth end, and causes the second linking plate to swing the retention lever to the retaining position. The magazine lid, while swung toward the open position, causes the first linking plate to pull the second linking plate, and swings the retention lever to the releasing position.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

The supply magazine of the present invention is effective in supplying recording paper upon being mechanically driven by a printer, and also in protecting the recording paper in a state shielded from ambient light, air and moisture.

Figure 1:
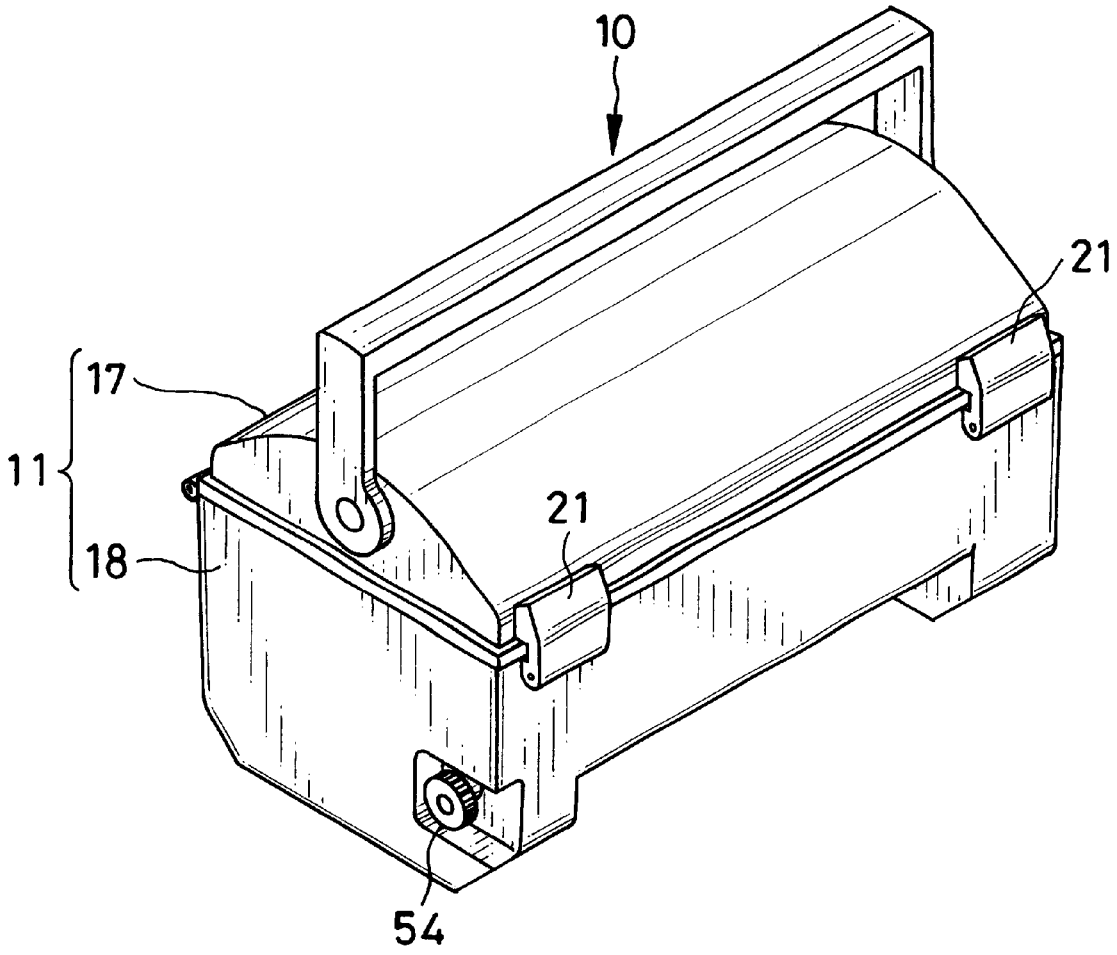
FIG. 1 is a perspective illustrating a supply magazine of the present invention.
Figure 2:
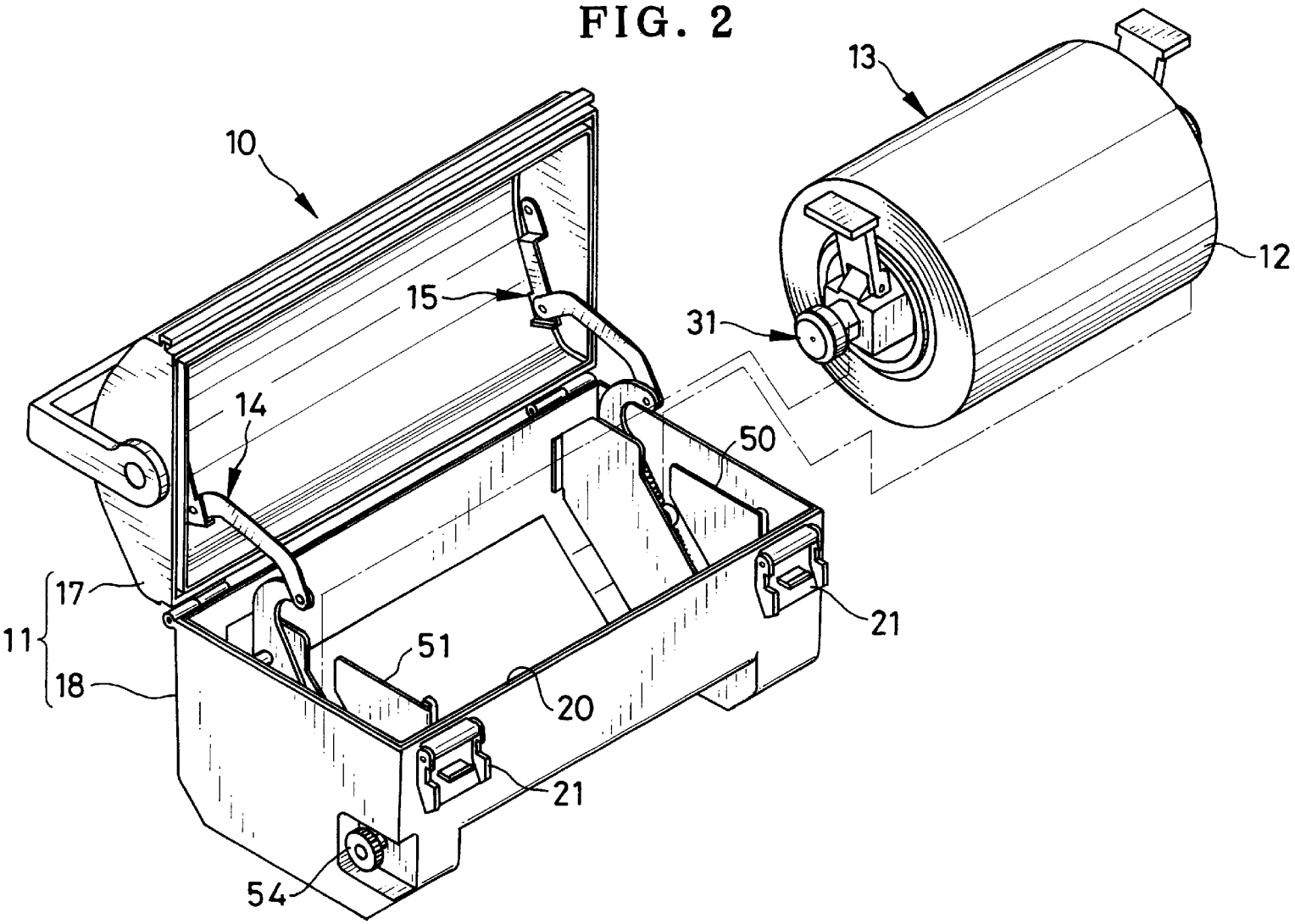
FIG. 2 is a perspective illustrating the supply magazine and a recording material roll with a roll holder.
Figure 3:
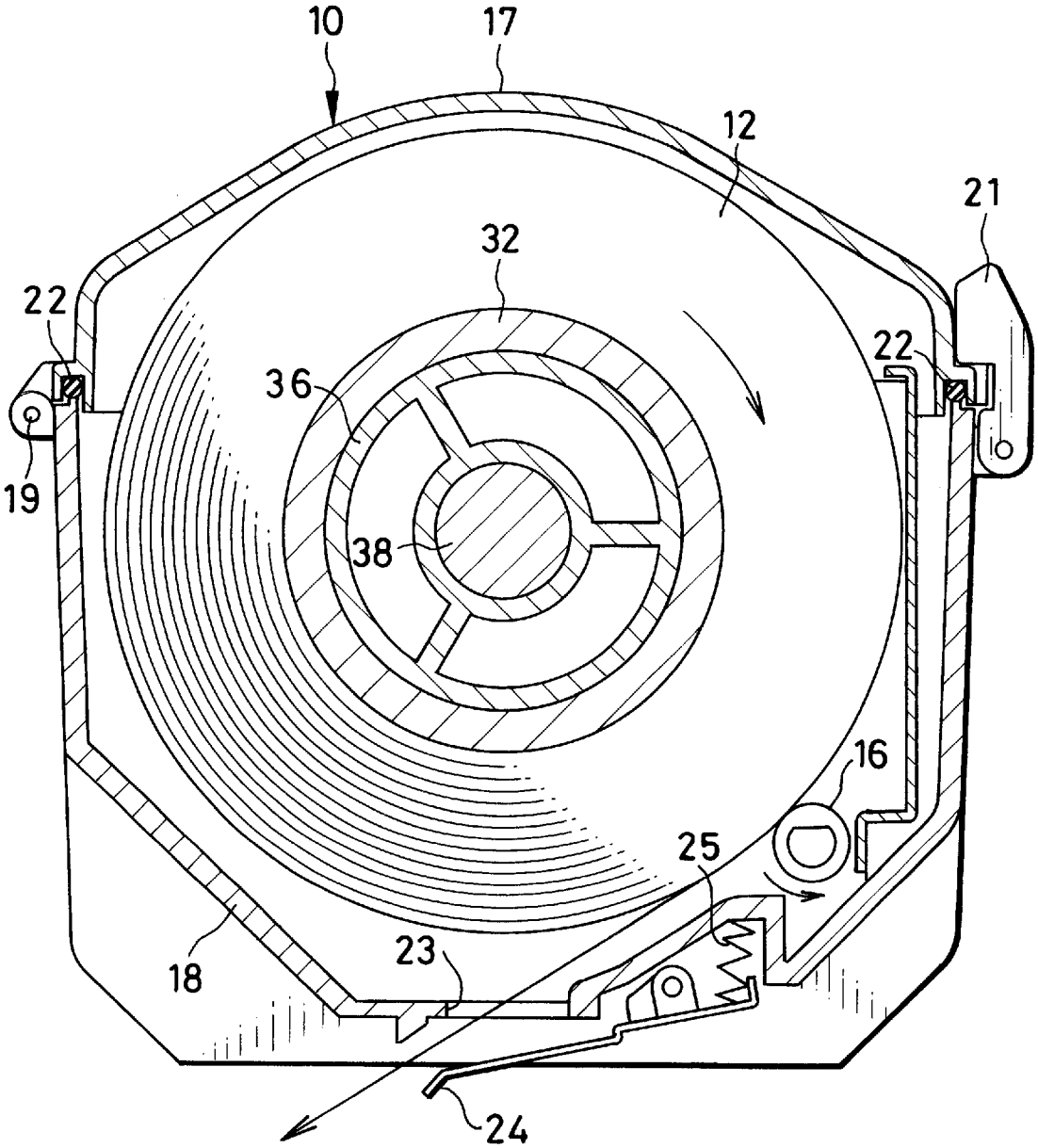
FIG. 3 is a cross section illustrating the same as FIG. 2 but in a contained state.

In FIGS. 1-3, a magazine/roll combination 10 includes a supply magazine 11, a roll/holder combination 13, a pair of pushing mechanisms 14 and 15 and a supply roller 16. The supply magazine 11 has a shape of a rectangular parallelepipedon. The roll/holder combination 13 is contained in the supply magazine 11. The supply magazine 11 is constituted of a magazine lid 17 and a magazine body 18. The magazine body 18 is disposed about the roll/holder combination 13. A hinge mechanism 19 secures the magazine lid 17 to the magazine body 18 in a pivotally movable manner. A magazine opening 20 is defined as an upper gap of the magazine body 18. The magazine lid 17 is movable between open and closed positions with a difference in the rotational angle more than 90 degrees, and when in the open position of FIG. 1, opens the magazine opening 20, and when in the closed position of FIG. 2, closes the magazine opening 20.

Buckles 21 are provided on the magazine body 18, and movable between locked and unlocked positions, and when in the locked position, lock the magazine lid 17 in the closed state, and when in the unlocked position, allow the magazine lid 17 to open. In FIG. 3, a packing 22 is secured to the magazine body 18 on a juncture edge to receive the magazine lid 17, and shields the inside of the magazine body 18 from air or moisture.

An exit passageway 23 is formed in a lower wall of the magazine body 18. Continuous recording paper 12 as continuous recording material exits through the exit passageway 23. A lower lid 24 is secured to close the exit passageway 23. The lower lid 24 is movable between open and closed positions to open and close the exit passageway 23. A spring 25 biases the lower lid 24 toward the closed position. A drive mechanism in a printer is connected to the lower lid 24, and pushes the lower lid 24 at the time of paper supply to the open position.

Figure 4:
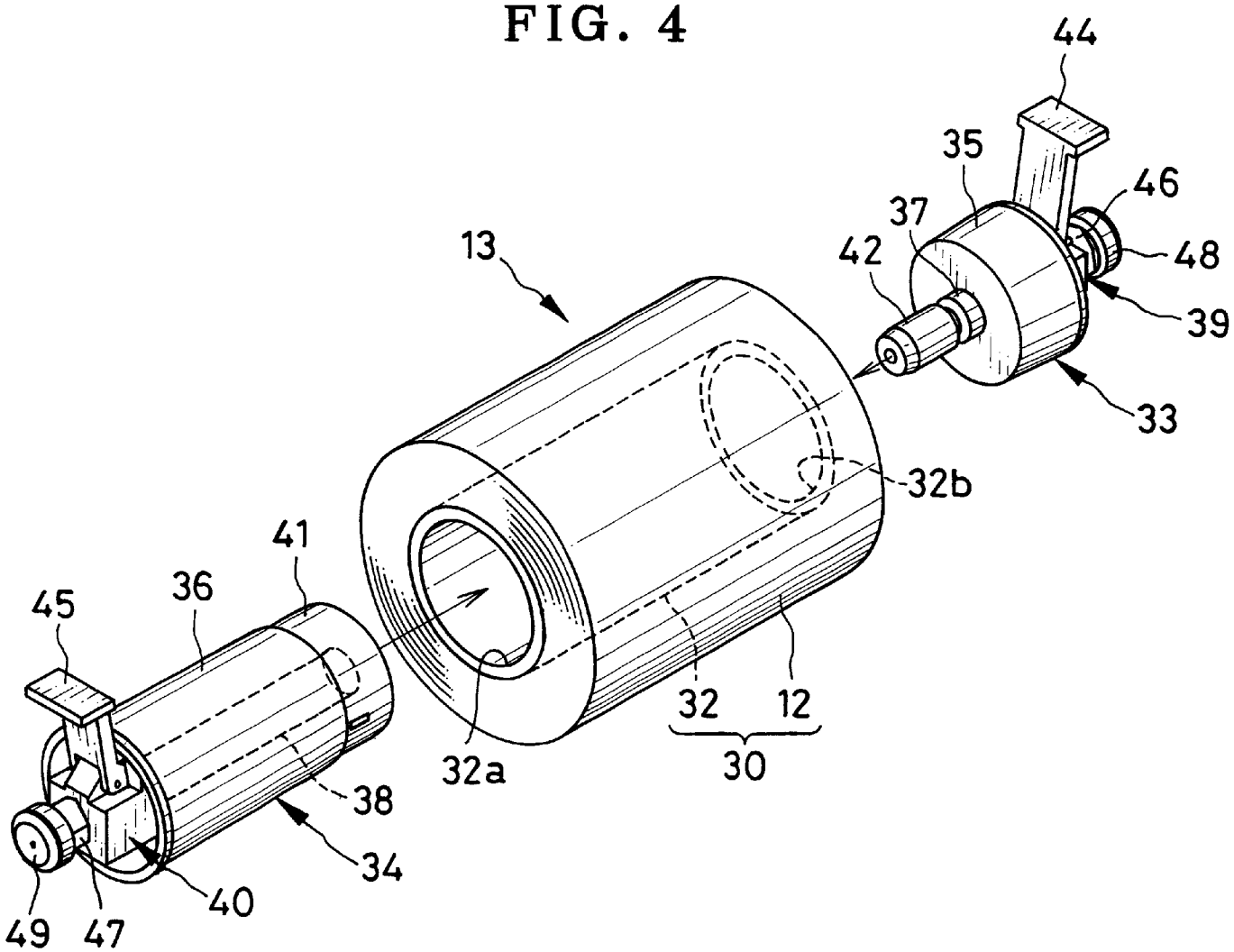
FIG. 4 is a perspective illustrating the recording material roll with the roll holder.

In FIG. 4, the roll/holder combination 13 is constituted by a recording paper roll 30 as recording material roll and a roll holder 31. A tubular spool 32 is included in the recording paper roll 30, has a hollow shape, and is provided with the recording paper 12 wound in a roll form. The roll holder 31, when removed from the recording paper roll 30, is set on an unused recording paper roll.

Figure 5:
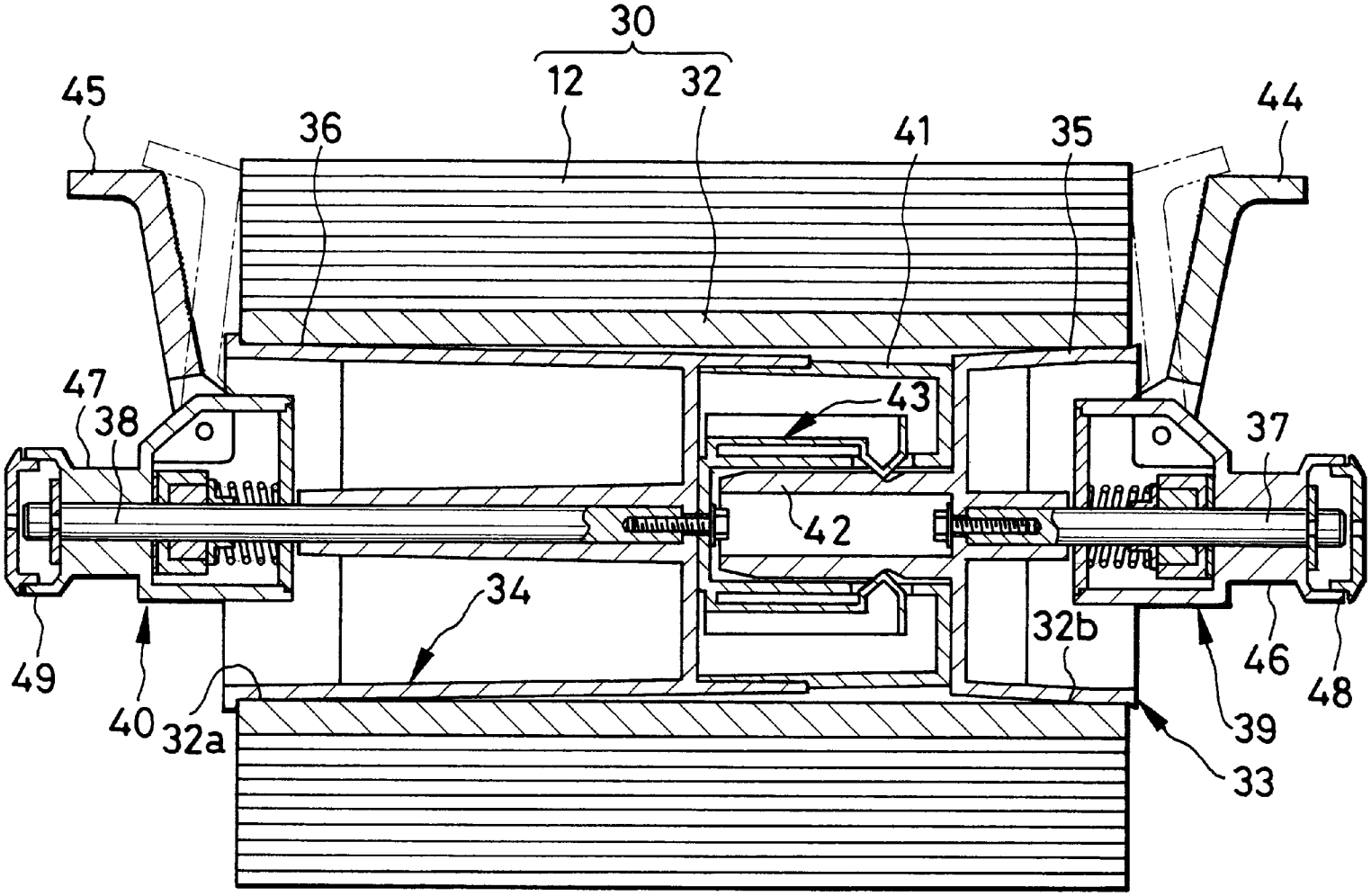
FIG. 5 is a vertical section illustrating the roll holder and the recording material roll.

The roll holder 31 is constituted by a shorter holder 33 and a longer holder 34. An axial hole 32*a* is formed at an end of the tubular spool 32, and receives the longer holder 34 fitted therein with tightness. An axial hole 32*b* is formed at a remaining end of the tubular spool 32, and receives the shorter holder 33 fitted therein with tightness. As illustrated in FIG. 5, the shorter holder 33 includes a drum 35, a drum shaft 37 and an axial end part 39. The longer holder 34 includes a drum 36, a drum shaft 38 and an axial end part 40. The drums 35 and 36 support the tubular spool 32 in contact with its inner surface. The drum shafts 37 and 38 support the drums 35 and 36.

The axial end parts 39 and 40 support axial ends of the drum shafts 37 and 38 protruding outside the tubular spool 32 in a rotatable manner. A connection sleeve 41 is secured to the longer holder 34 at a central end of the drum shaft 38. A connection core 42 is formed with the shorter holder 33 and a central end of the drum shaft 37. A retention mechanism 43 for engagement with a click is incorporated in the connection sleeve 41 and the connection core 42. The retention mechanism 43 is readily actuated for engagement and disengagement of the connection sleeve 41 and the connection core 42 in response to application of pulling force or compressing force to the same in an axial direction of the drum shafts 37 and 38. When the retention mechanism 43 comes in an engaged state, the drum shafts 37 and 38 are combined in a coaxial manner with each other in a straight manner. The drums 35 and 36 are combined with each other in a manner of a single drum.

The axial end part 39 has a handle 44, a guide surface 46 and a driven end rod 48. The axial end part 40 has a handle 45, a guide surface 47 and a driven end rod 49. The handles 44 and 45 are movable to and away from an edge of the recording paper 12, and operate in two manners of a grip and a regulating plate. The handles 44 and 45, as grip, are grasped to raise and convey the recording paper roll 30 manually, and as regulator, push and neaten end faces of the recording paper roll 30. The guide surfaces 46 and 47 and the driven end rods 48 and 49 are disposed on extensions of respectively the drum shafts 37 and 38. The guide surfaces 46 and 47 are inserted in guide cutouts which will be later described. A retention lever 59 pushes each of the driven end rods 48 and 49, which have shapes of flanges projecting from the guide surfaces 46 and 47 with a greater diameter.

Figure 6:
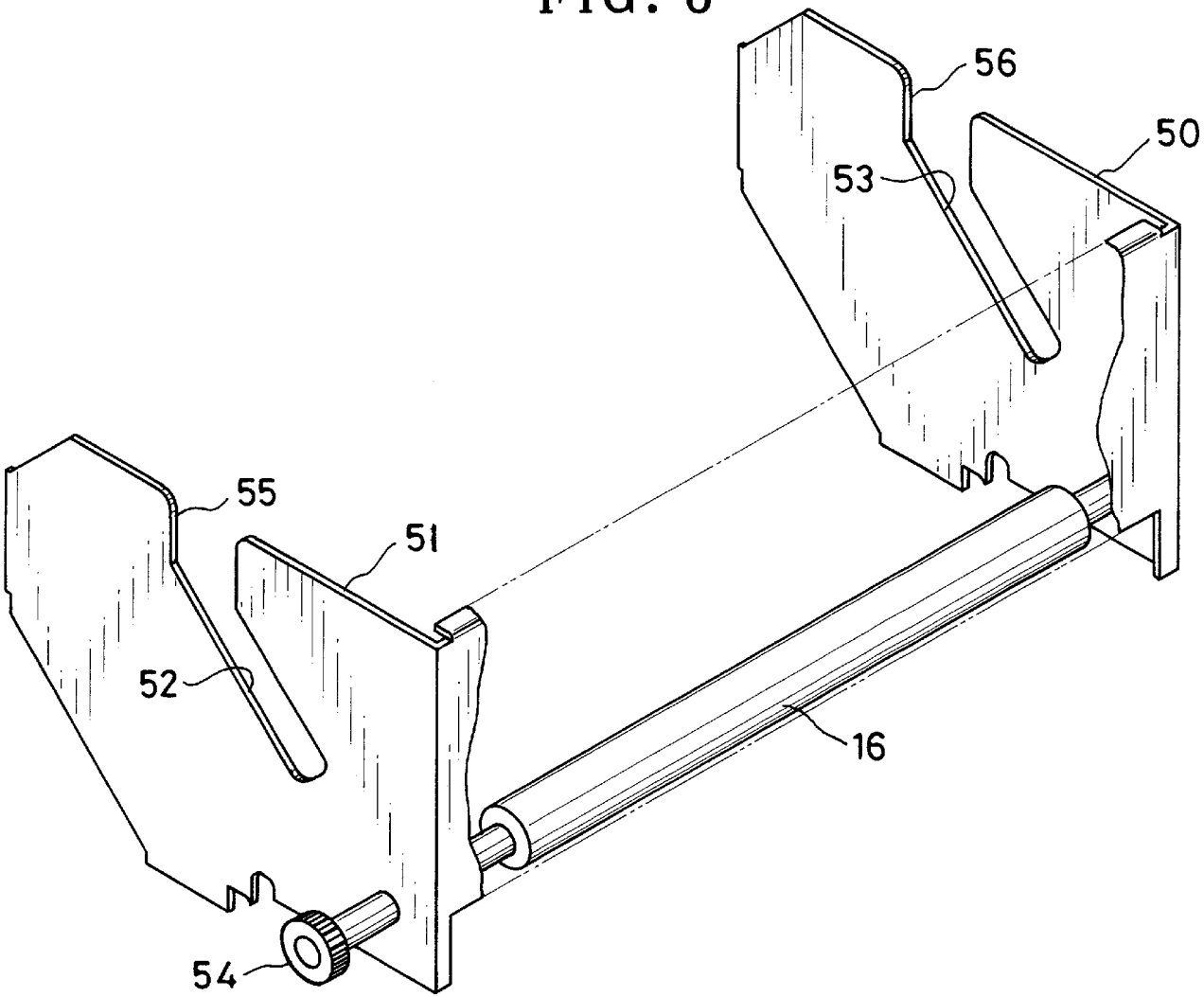
FIG. 6 is a perspective illustrating a supply roller and a pair of support plates.

In FIG. 6, a pair of support plates 50 and 51 are secured to the inside of the magazine body 18, opposed to each other, and constituted of a single plate bent in a channel shape. The support plates 50 and 51 support ends of the supply roller 16 in a rotatable manner. Guide cutouts 52 and 53 are formed in the support plates 50 and 51 and receive insertion of the guide surfaces 46 and 47. A gear 54 is secured to one axial end of the supply roller 16 and rotated by a mechanism in the printer. In FIG. 2, the gear 54 is disposed outside the supply magazine 11.

Entrances 55 and 56 are formed in the support plates 50 and 51, and introduce the guide surfaces 46 and 47 toward the guide cutouts 52 and 53. The guide cutouts 52 and 53 have such a direction and length as to guide the roll/holder combination 13 to the supply roller 16 to keep an outer turn of the recording paper 12 in contact with the supply roller 16 irrespective of the diameter of the recording paper roll 30.

The pushing mechanism 14 is disposed between the support plate 51 and a lateral wall of the magazine body 18. The pushing mechanism 15 is disposed between the support plate 50 and a wall of the magazine body 18. The pushing mechanisms 14 and 15 are actuated in response to opening and closing movement of the magazine lid 17, and when the magazine lid 17 is closed, push the recording paper 12 toward the supply roller 16 and blocks removal of the roll/holder combination 13. The pushing mechanisms 14 and 15, when the magazine lid 17 is opened, allows removal of the roll/holder combination 13.

Figure 7:
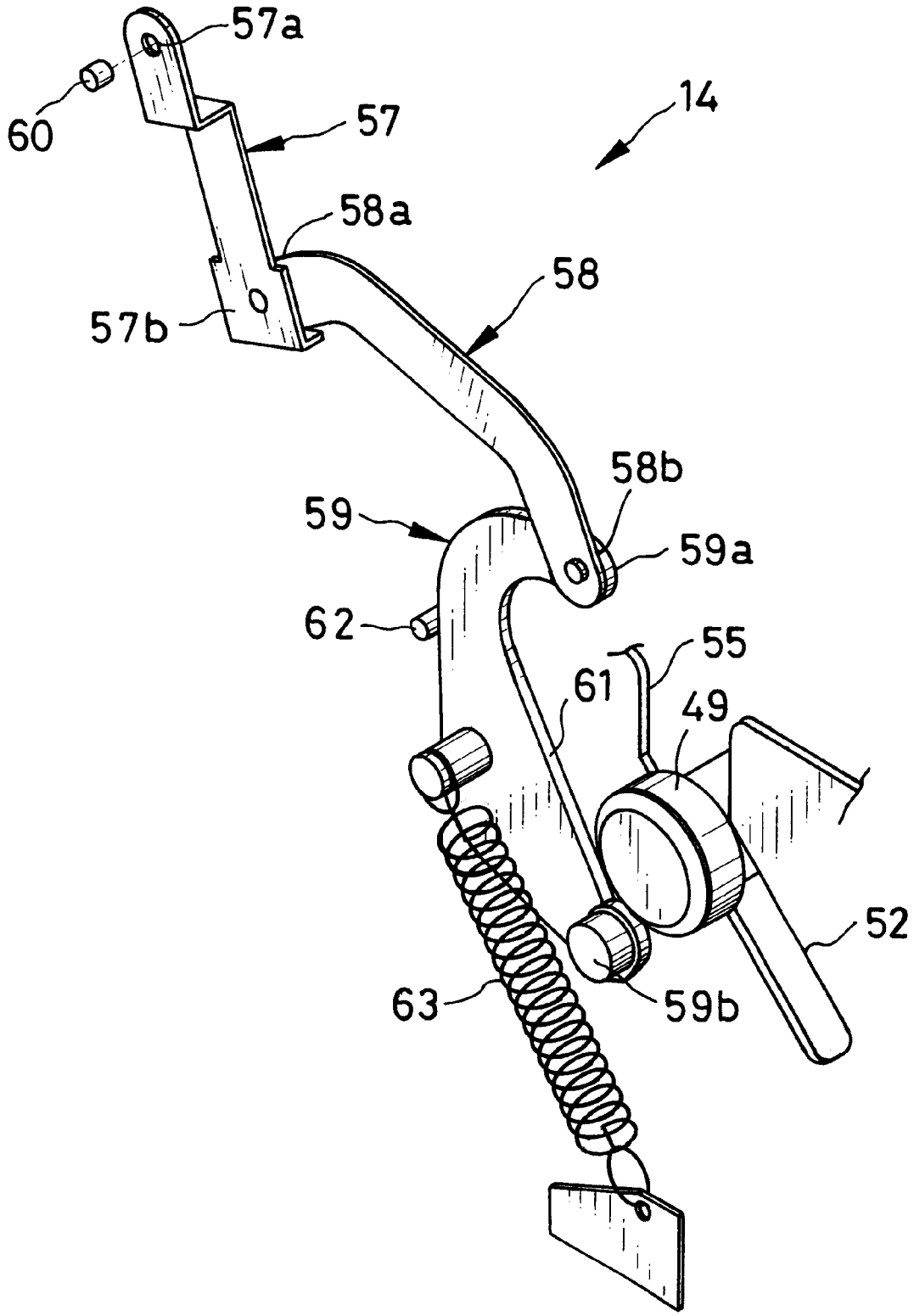
FIG. 7 is a perspective illustrating a retention lever and two linking plates with relevant elements.

In FIG. 7, the pushing mechanism 14 is constituted by a first linking plate 57, a second linking plate 58 and the retention lever 59, any of which have sufficiently high rigidity. The first and second linking plates 57 and 58 are included in a linking mechanism. A plate end 57*a* in the first linking plate 57 or a first end is connected with a pin 60 in a rotatable manner. A plate end 57*b* in the first linking plate 57 is connected with a plate end 58*b* in the second linking plate 58 in a rotatable manner. A plate end 58*b* in the second linking plate 58 or a second end is connected with a lever end 59*a* of the retention lever 59 in a rotatable manner.

There are a pivotal pin 59*b* and a driving edge 61 in the retention lever 59. The pivotal pin 59*b* is supported on the magazine body 18 in a rotatable manner. The retention lever 59 rotates about a center at the pivotal pin 59*b*, and when in an retaining position, presses the driving edge 61 against the driven end rods 48 and 49, and when in an releasing position, discontinues applying pressure to the driven end rods 48 and 49. A stopper 62 is contacted by the retention lever 59 in the releasing position.

A tension coil spring 63 in the bias mechanism is connected with the retention lever 59. The bias mechanism has a dead point defined within a rotating range of the magazine lid 17, and operates as a toggle spring in such a manner that the tension coil spring 63 biases the retention lever 59 toward a selected one of the retaining and releasing positions when the magazine lid 17 comes past the dead point. Note that the pushing mechanism 15 is structurally the same as the pushing mechanism 14 described with FIG. 7.

Figure 8:
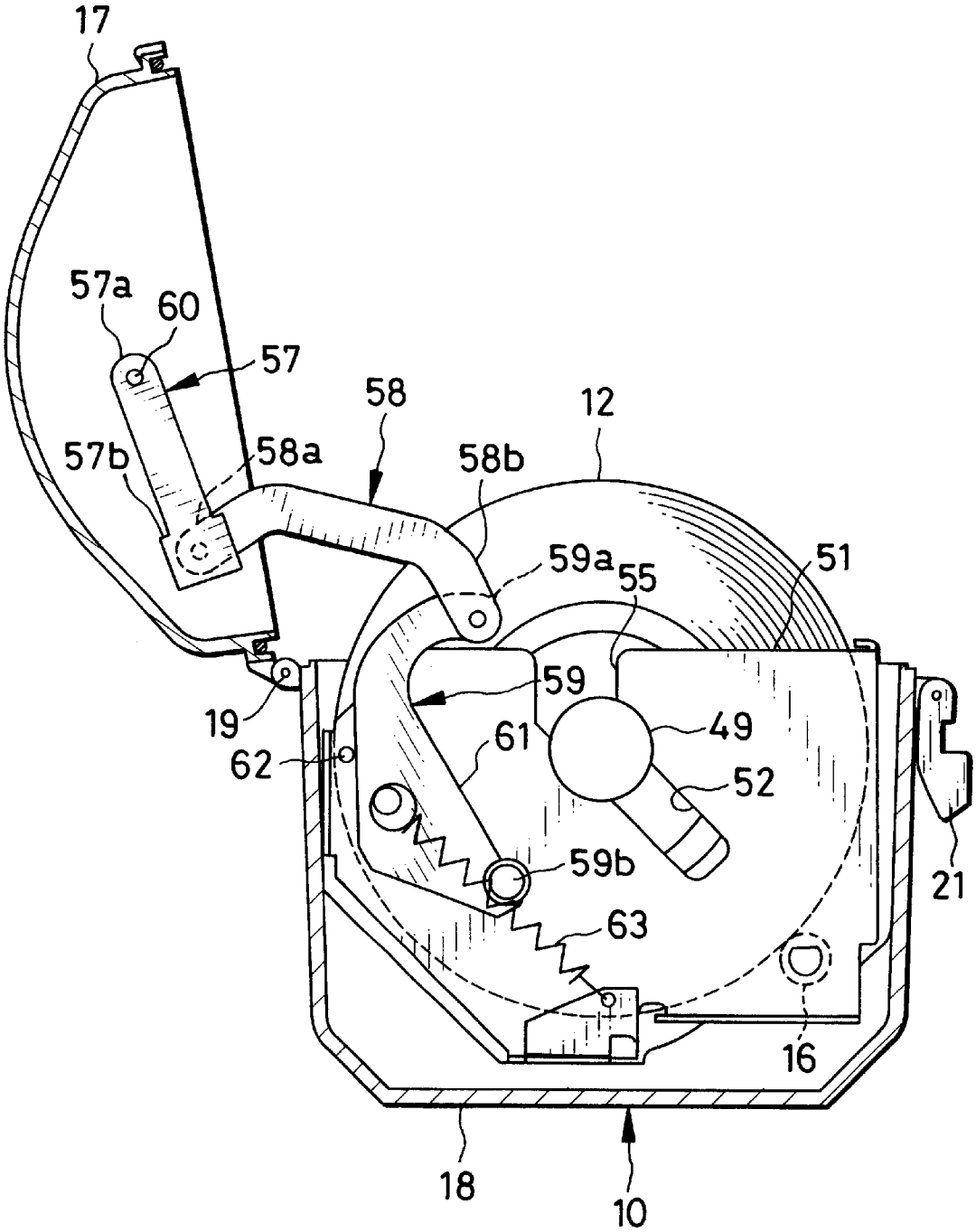
FIG. 8 is an explanatory view, partially in section, illustrating the supply magazine and the recording material roll with the roll holder and in a state with a magazine lid open.
Figure 9:
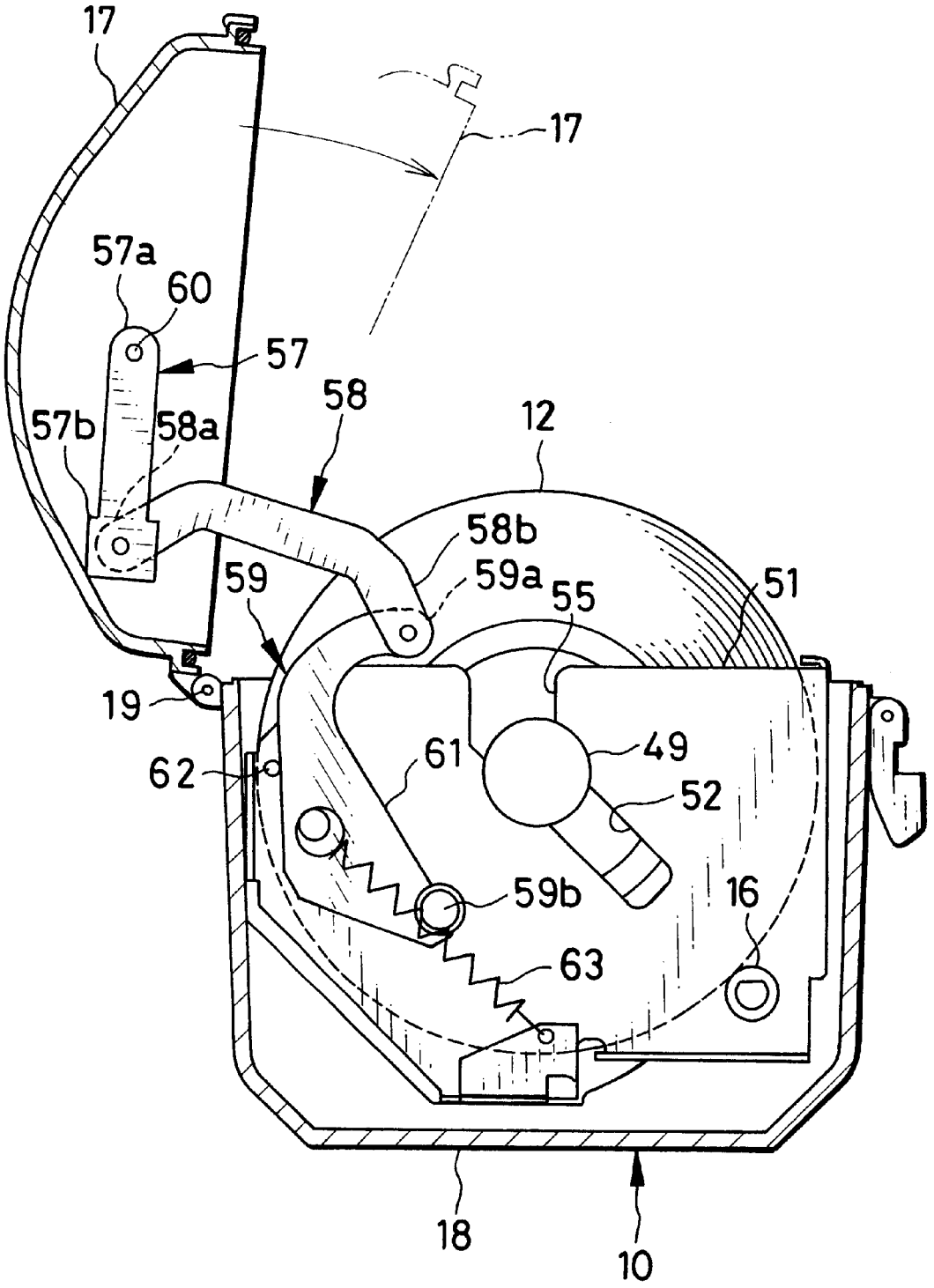
FIG. 9 is an explanatory view, partially in section, illustrating the same as FIG. 8 and in a state of a start of closing of the magazine lid.
Figure 10:
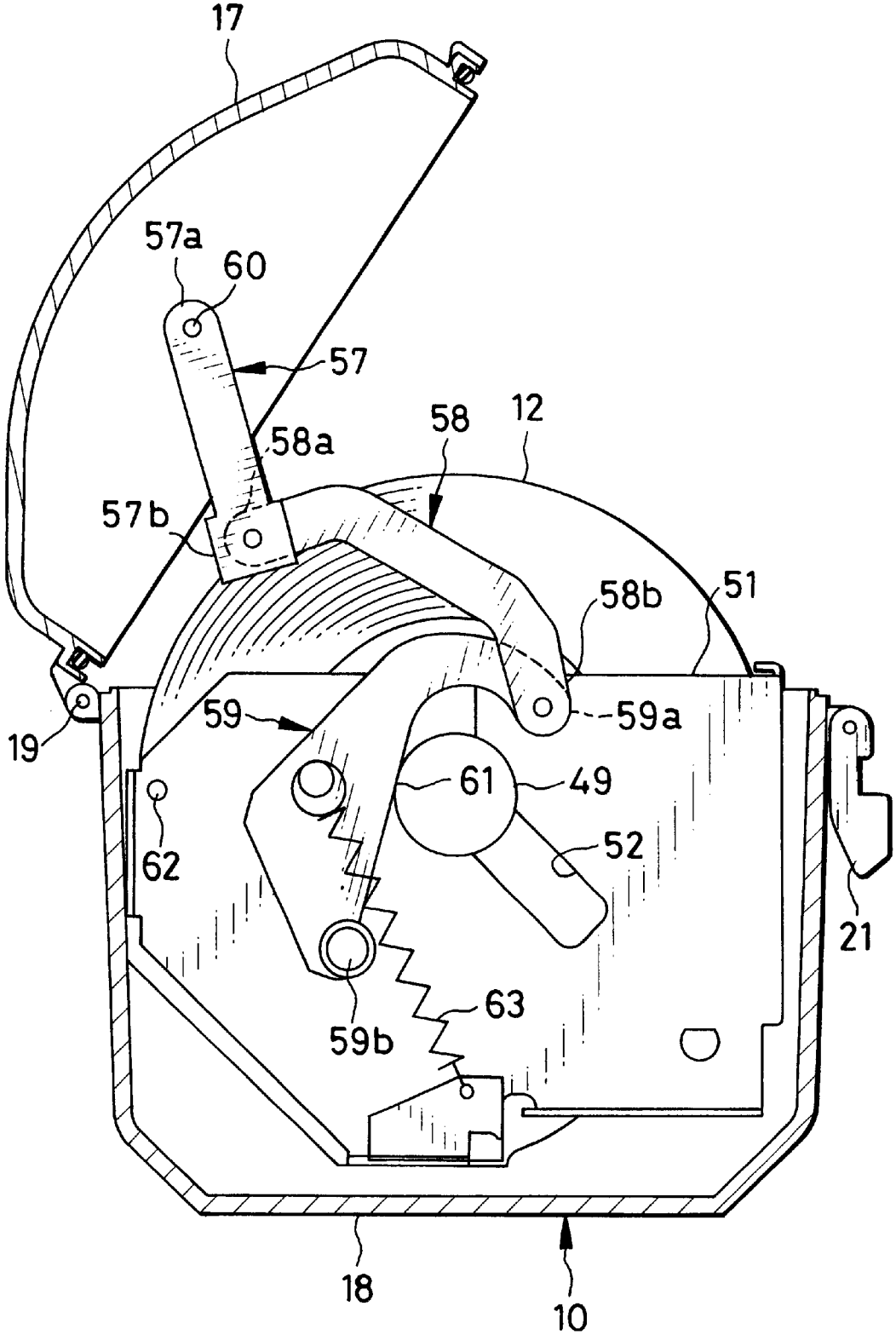
FIG. 10 is an explanatory view, partially in section, illustrating the same as FIG. 8 and in a state of halfway closing of the magazine lid.

In FIGS. 8–10, while the magazine lid 17 swings from the open position to an intermediate position or dead point, the first and second linking plates 57 and 58 do not transmit rotation of the magazine lid 17 to the retention lever 59, because the plate ends 57*b* and 58*a* move in reverse to the closing direction of the magazine lid 17. When the magazine lid 17 starts swinging from the intermediate position to the closed position, the plate ends 57*b* and 58*a* are pushed by the magazine lid 17 and transmit rotation of the magazine lid 17 to the retention lever 59. Consequently, the opening and closing movement of the magazine lid 17 is transmitted indirectly with respect to the retention lever 59. This is effective in preventing such accidents that a user's fingers might be squeezed between the magazine body 18 and the magazine lid 17 closed by the tension coil spring 63.

Figure 11:
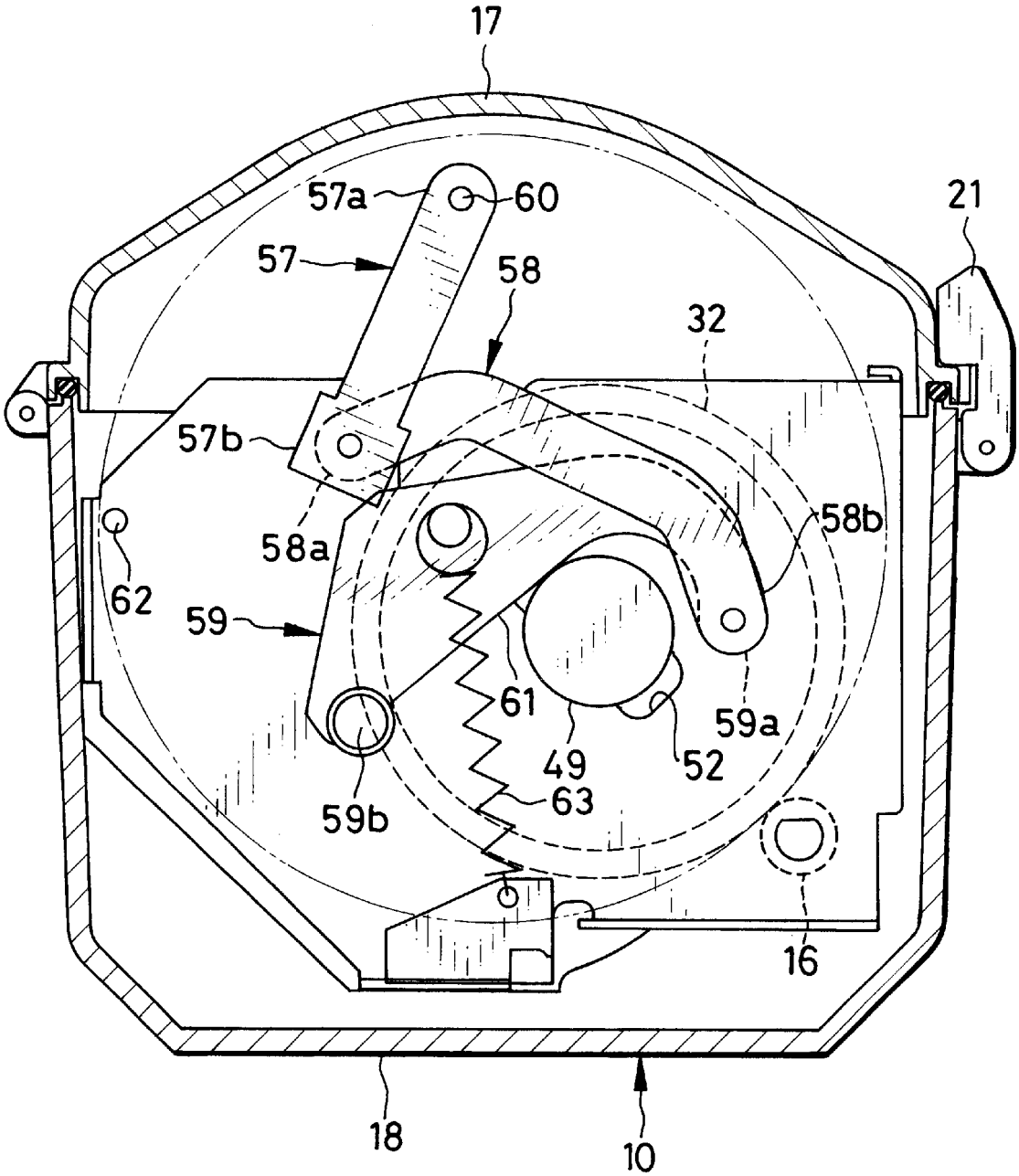
FIG. 11 is an explanatory view, partially in section, illustrating the same as FIG. 8 and in a state where the magazine lid is closed and the recording material roll is used up.

The effective position or retaining position of the retention lever 59 changes according to a change in the diameter of the recording paper roll 30. In FIG. 11, even when the roll/holder combination 13 comes close to the supply roller 16 with the recording paper 12 decreased, the retention lever 59 is swung by the tension coil spring 63 to follow the recording paper roll 30. The retention lever 59 has an arc-shaped edge between the pivotal pin 59*b* and the lever end 59*a*. The driving edge 61 is disposed on a tangential line that lies through the center of the pivotal pin 59*b* and is tangential to the arc-shaped edge. No matter how the effective position or retaining position of the retention lever 59 changes, the retention lever 59 can push the driven end rod 49 toward the supply roller 16. So the outermost turn of the recording paper 12 can be contacted by the supply roller 16 stably irrespective of the roll diameter.

Figure 12:
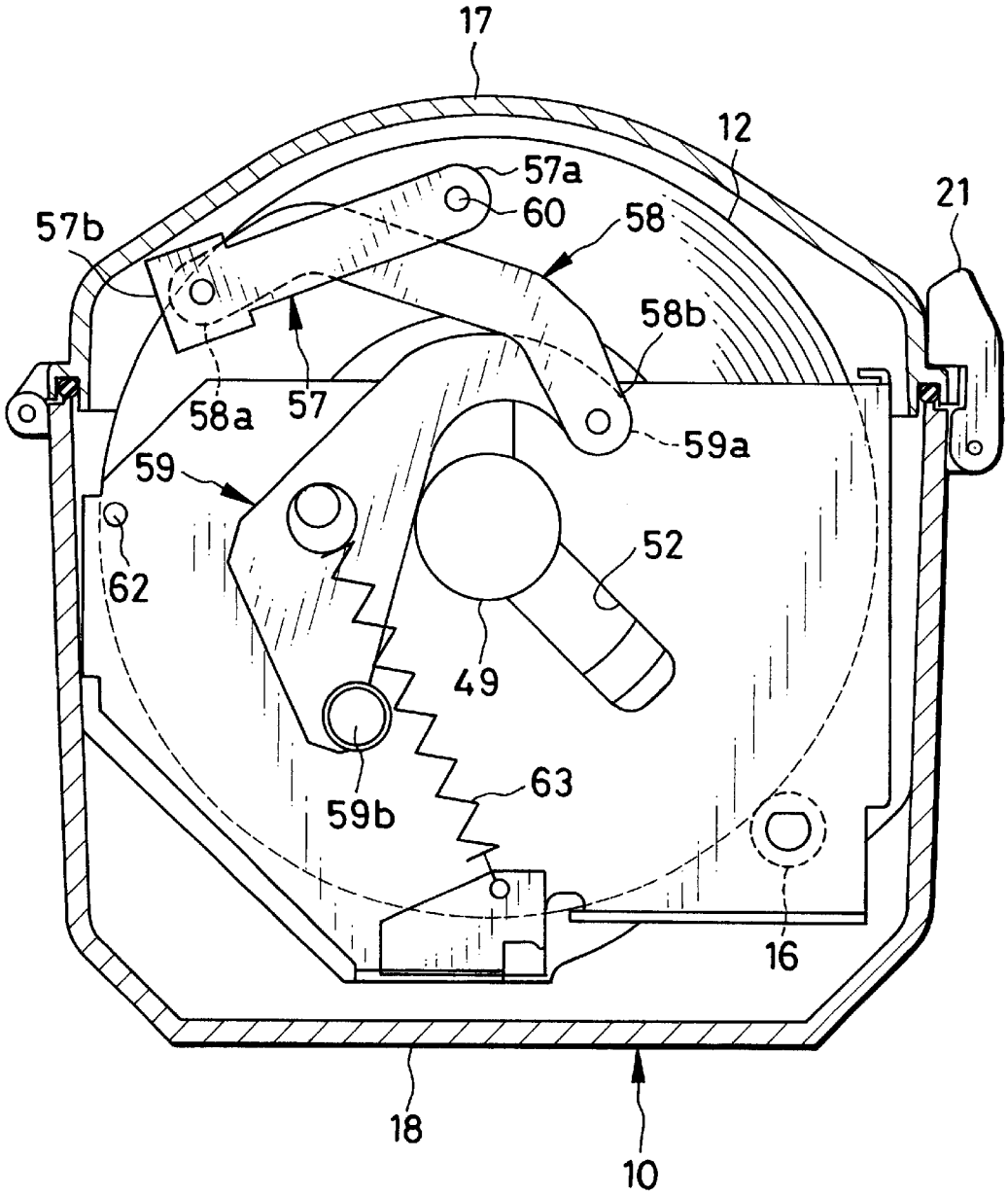
FIG. 12 is an explanatory view, partially in section, illustrating the same as FIG. 12 and but a state in which a recording material roll is unused with a great diameter.

At the time of opening the magazine lid 17 from the closed position of FIGS. 11 and 12, the first and second linking plates 57 and 58 do not transmit movement of the magazine lid 17 to the retention lever 59 in a section from the closed position to an intermediate position. When the magazine lid 17 is in a position in a section from the intermediate position to the open position, the first and second linking plates 57 and 58 transmit movement of the magazine lid 17 to the retention lever 59. Therefore, the first and second linking plates 57 and 58 become free when the magazine lid 17 is in the closed position. The retention lever 59 is allowed to shift at an amount according to a decreasing diameter of the roll.

The operation of the above embodiment is described now. To assemble the roll/holder combination 13, the roll holder 31 is set on the recording paper roll 30 in an unused state. The shorter and longer holders 33 and 34 are fitted in the axial holes 32*a* and 32*b* of the tubular spool 32. Then the connection sleeve 41 and the connection core 42 are connected to each other inside the tubular spool 32. A user grasps the handles 44 and 45 manually. So the handles 44 and 45 rotate to the positions indicated by the phantom lines in FIG. 5 to neaten end faces of the recording paper roll 30, and also operate to facilitate handling of the roll/holder combination 13 as a single component.

The roll/holder combination 13 being obtained is then inserted into the magazine body 18. The guide surfaces 46 and 47 are simultaneously set into the guide cutouts 52 and 53. The guide surface 46 is entered in the entrance 56 of the support plate 50 and moved to the guide cutout 53. Also, the guide surface 47 is entered in the entrance 55 of the support plate 51 and moved to the guide cutout 52. After the insertion, the recording paper roll 30 comes close to the supply roller 16 by sliding of the guide surfaces 46 and 47 through the guide cutouts 52 and 53. Finally, the magazine lid 17 is closed.

In FIG. 9, while the magazine lid 17 swings from the open position to the intermediate position, the rotation of the magazine lid 17 is not transmitted to the retention lever 59, because the plate ends 57*b* and 58*a* of the first and second linking plates 57 and 58 move in reverse to the closing direction of the magazine lid 17. The retention lever 59 still remains in the releasing position and in contact with the stopper 62. When the magazine lid 17 swings from the intermediate position to the phantom line position of FIG. 9 in the closing direction, the plate ends 57*b* and 58*a* of the first and second linking plates 57 and 58 are pushed by the inside of the magazine lid 17 and transmit the rotation of the magazine lid 17 to the retention lever 59. Therefore, the retention lever 59 starts swinging toward the retaining position against the tension coil spring 63. For closing movement of the magazine lid 17, the user's hand can touch a swinging edge of the magazine lid 17 the farthest from the hinge mechanism 19. An inner portion of the magazine lid 17 pushing the plate ends 57*b* and 58*a* is nearer to the hinge mechanism 19 than the swinging edge of the magazine lid 17. According to the lever operation, it is sufficient for the user's hand to exert relatively small force to the magazine lid 17 to be closed.

The closing movement of the magazine lid 17 rotates the retention lever 59 toward the retaining position. When the retention lever 59 rotates beyond the intermediate position of the bias mechanism including the tension coil spring 63, the direction of the bias changes over to a direction toward the retaining position. Therefore, the tension coil spring 63 rotates the retention lever 59 toward the retaining position. In FIG. 10, the driving edge 61 comes in contact with the driven end rod 49. The retention lever 59 is maintained in the retaining position. The user manually swings the magazine lid 17 to the closed position. While the magazine lid 17 swings, the plate end 57*b* of the first linking plate 57 and the plate end 58*a* of the second linking plate 58 move away toward the hinge mechanism 19. The retention lever 59 becomes free with respect to the magazine lid 17 and the first and second linking plates 57 and 58. After the magazine lid 17 is closed, the buckles 21 are locked. Therefore, the inside of the supply magazine is enclosed in an air-tight state. See FIG. 12.

The supply magazine 11 is loaded with the recording paper 12, for example thermosensitive recording sheet of a continuous form, and set in a chamber in a color thermal printer well-known in the art. When a starting signal is entered in the printer, the drive mechanism is driven to open the lower lid 24. Also, a feeding motor in the printer rotates the supply roller 16 to cause the recording paper 12 to advance through the exit passageway 23 and into the printer.

The recording paper 12, when supplied into the printer, is fed by feeder rollers to a printing unit according to three-color frame-sequential recording. The printing unit feeds the recording paper 12 in forward and backward directions, and when in the forward feeding, prints and fixes yellow, magenta and cyan colors. Accordingly, the supply roller 16 is rotated back and forth during the printing and fixing operation.

After the recording, the recording paper 12 is fed to a cutter in the printer. A cutting line of the recording paper 12 is positioned at the cutter, which is actuated so as to cut away one print sheet from the recording paper 12 with an image recorded. The print sheet is ejected from the printer. If further printing operation is desired consecutively, then a front edge of the recording paper 12 is returned. Another image is recorded to the recording paper 12 in a similar manner. After the printing operation, the feeder rollers and the supply roller 16 are rotated backwards to wind back the front edge portion of the recording paper 12 into the supply magazine 11. Note that an amount of winding back is so predetermined that the front edge of the recording paper 12 will not come short of the supply roller 16.

Renewal of the recording paper roll 30 is described now. When the magazine/roll combination 10 is removed from the chamber in the printer, the roll/holder combination 13 is in a position shifted close to the supply roller 16 as illustrated in FIG. 11, because the amount of the recording paper 12 has become zero. The retention lever 59 is in the retaining position where it contacts the driven end rod 49.

After the removal of the magazine/roll combination 10, the buckles 21 are unlocked. The magazine lid 17 is allowed to open. Then the user pulls the magazine lid 17 open. Even when the magazine lid 17 comes to the intermediate position of FIG. 10, the retention lever 59 still remains in the retaining position, because the plate end 57*b* of the first linking plate 57 and the plate end 58*a* of the second linking plate 58 are shifted in the position close to the hinge mechanism 19.

Movement of the magazine lid 17 to a solid-line position indicated in FIG. 9 short of the open position causes the plate end 57*b* of the first linking plate 57 and the plate end 58*a* of the second linking plate 58 to lie on a line that passes the plate end 57*a* of the first linking plate 57 and the plate end 58*b* of the second linking plate 58. Thus, the first linking plate 57 pulls the second linking plate 58 to start transmission of rotation to the retention lever 59. Therefore, the retention lever 59 rotates to the releasing position against the bias of the tension coil spring 63. Before the retention lever 59 moves past the intermediate position, manual force to open the magazine lid 17 needs be stronger than the bias of the tension coil spring 63. However, once the retention lever 59 swings to pass the intermediate position, the tension coil spring 63 exerts force to swing the retention lever 59 to the releasing position. This also makes it easy to open the magazine lid 17.

The retention lever 59, when swung past the intermediate position, is swung by the tension coil spring 63 toward the releasing position, and comes in contact with the stopper 62 before coming of the magazine lid 17 to the open position. The retention lever 59 remains in the releasing position in contact with the stopper 62 of FIG. 9. Then the magazine lid 17 continues swinging in the opening direction. Upon coming to the open position, the magazine lid 17 is kept open by the hinge mechanism 19 as illustrated in FIG. 8. The entrance 55 is in a fully uncovered state.

Then the roll/holder combination 13 is removed from the magazine body 18. The roll holder 31 is removed from the tubular spool 32. The shorter and longer holders 33 and 34 are pulled away from each other. The retention of the retention mechanism 43 is easily discontinued to disconnect the shorter holder 33 from the longer holder 34.

In the above embodiment, the first and second linking plates 57 and 58 link the magazine lid 17 to the retention lever 59. Furthermore, a linking mechanism may be constituted by three or more elements connected with one another. In the above embodiment, the recording paper roll 30 is pressed against the supply roller 16. Alternatively, it is possible to shift the supply roller 16 toward the recording paper roll 30. Furthermore, it is possible that one mechanism shifts the recording paper roll 30 toward the supply roller 16 and a second mechanism shifts the supply roller 16 toward the recording paper roll 30 for the purpose of reliably tight contact.

In the above embodiment, the supply roller 16 is contained in the supply magazine 11. However, the supply magazine 11 may not have the supply roller 16 according to the present invention. The supply magazine 11 without the supply roller 16 is used with a printer having the supply roller 16. An insertion opening is formed in the magazine body 18 for insertion of the supply roller 16 into the supply magazine 11 upon setting of the supply magazine 11 into the printer. The supply roller 16 comes in contact with the outermost turn of the recording paper roll 30. Again, the recording paper roll 30 is pressed by the retention lever 59 toward the supply roller 16. Note that it is preferable that the magazine body 18 can have a lid for closing the insertion opening in the magazine body 18 upon removal of the supply magazine 11 from the printer.

In the above embodiment, the guide cutouts 52 and 53 are formed in the support plates 50 and 51. Alternatively, lateral wall of the magazine body may be provided with inner guide rails or inner guide ridges to guide the guide surfaces 46 and 47.

In the above embodiments, the supply magazine 11 is used with the color thermal printer. However, a supply magazine of the invention may be constructed for use with a photographic printer in which photographic paper of a silver halide type is used. The recording paper 12 may be an ordinary PPC type of paper that does not require shielding from light or moisture. Also in such a use, the recording paper roll 30 can be set in the printer very easily with portability, and the recording paper 12 can be advanced reliably.

In the above embodiment, rotation of the magazine lid 17 in a closing direction is transmitted to the retention lever 59 when the plate ends 57*b* and 58*a* are pushed by the magazine lid 17. To be precise, the inner surface of the magazine lid 17 pushes only the plate end 57*b* directly. Furthermore, the inside of the magazine lid 17 can push both of the plate ends 57*b* and 58*a* , or push only the plate end 58*a*.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A supply magazine for containing a recording material roll having continuous recording material wound in a roll form, inside which said recording material roll is rotated by a supply roller for unwinding and winding said recording material, said supply magazine comprising:

a magazine body for receiving said recording material roll;

a magazine lid for closing said magazine body openably;

at least one retention lever, shiftable between retaining and releasing positions, for pressing an outermost turn of said recording material roll to said supply roller when in said retaining position, and for releasing said recording material roll from said supply roller when in said releasing position; and a linking mechanism, having first and second ends, said first end being connected with said magazine lid, said second end being connected with said retention lever, said linking mechanism shifting said retention lever from said releasing position to said retaining position in response to closing of said magazine lid.

2. A supply magazine as defined in claim 1, further comprising:

a magazine opening, formed in said magazine body and closed by said magazine lid after being loaded with said recording material roll;

a hinge for keeping said magazine lid pivotally movable on said magazine body between closed and open positions.

3. A supply magazine as defined in claim 2, wherein said supply roller is contained in said magazine body.

4. A supply magazine as defined in claim 3, further comprising an exit passageway, formed in said magazine body and close to said supply roller, for passage of said recording material.

5. A supply magazine as defined in claim 4, wherein said magazine lid and said magazine opening are disposed at a top of said magazine body, and said exit passageway is formed in a lower wall of said magazine body;

further comprising a lower lid for closing said exit passageway openably.

6. A supply magazine as defined in claim 5, further comprising:

a roll holder, secured to said recording material roll, and having first and second axial end parts disposed outside said recording material roll;

first and second support plates, disposed in said magazine body, and opposed to each other;

first and second cutouts, formed through said first and second support plates, for receiving insertion of said first and second axial end parts;

wherein said at least one retention lever comprises first and second retention levers for pushing respectively said first and second axial end parts directly or indirectly.

7. A supply magazine as defined in claim 6, wherein said first and second retention levers push portions of respectively said first and second axial end parts located outside said first and second support plates.

8. A supply magazine as defined in claim 6, wherein said linking mechanism includes at least first and second linking plates, said first linking plate having said first end and a third end, said second linking plate having said second end and a fourth end connected with said third end in a pivotally movable manner, said first and second linking plates transmitting rotation of said magazine lid to said retention lever when said magazine lid is positioned within a limited section between said closed and open positions.

9. A supply magazine as defined in claim 8, further comprising a bias mechanism for biasing said retention lever toward said releasing position when said retention lever is between one intermediate position and said releasing position, and for biasing said retention lever toward said retaining position when said retention lever is between said intermediate position and said retaining position.

10. A supply magazine as defined in claim 9, further comprising a pivotal pin for securing said retention lever to said magazine body in a pivotally movable manner;

wherein said bias mechanism includes:

a tension coil spring;

a first securing portion for securing one end of said tension coil spring to said magazine body;

a second securing portion, positioned in said retention lever and on an extension of a line where said first securing portion and said pivotal pin lies, for securing a remaining end of said tension coil spring to said retention lever.

11. A supply magazine as defined in claim 9, wherein said magazine lid, while swung toward said closed position, pushes said third or fourth end, and causes said second linking plate to swing said retention lever to said retaining position;

said magazine lid, while swung toward said open position, causes said first linking plate to pull said second linking plate, and swings said retention lever to said releasing position.

12. A supply magazine for containing a recording material roll having continuous recording material wound in a roll form, said supply magazine comprising:

a magazine body for receiving said recording material roll;

a magazine lid for closing said magazine body openably;

a supply roller in said magazine body for feeding said recording material;

at least one retention lever, shiftable between retaining and releasing positions, for pressing an outermost turn of said recording material roll to said supply roller when in said retaining position, and for releasing said recording material roll from said supply roller when in said releasing position; and a linking mechanism, having first and second ends, said first end being connected with said magazine lid, said second end being connected with said retention lever, said linking mechanism shifting said retention lever from said releasing position to said retaining position in response to closing of said magazine lid.

13. A supply magazine as defined in claim 12, further comprising an exit passageway, formed in said magazine body and close to said supply roller, for passage of said recording material.

* * * * *